US010401769B2

(12) United States Patent
Nakatani

(10) Patent No.: US 10,401,769 B2
(45) Date of Patent: Sep. 3, 2019

(54) ELECTRONIC DEVICE AND IMAGE-FORMING APPARATUS

(71) Applicant: KYOCERA Document Solutions Inc., Osaka (JP)

(72) Inventor: Takanobu Nakatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/663,565

(22) Filed: Jul. 28, 2017

(65) Prior Publication Data

US 2018/0032014 A1 Feb. 1, 2018

(30) Foreign Application Priority Data

Jul. 28, 2016 (JP) ..... 2016-148358

(51) Int. Cl.
*G03G 15/00* (2006.01)
*G03G 15/20* (2006.01)

(52) U.S. Cl.
CPC ..... *G03G 15/5012* (2013.01); *G03G 15/5016* (2013.01); *G03G 15/553* (2013.01); *G03G 15/70* (2013.01); *G03G 15/2035* (2013.01); *G03G 2215/00548* (2013.01)

(58) Field of Classification Search
CPC .. G03G 15/5012; G03G 15/553; G03G 15/70; G03G 2215/00584; G03G 15/2071; G03G 15/5016; G03G 15/2035; G03G 2215/00548
See application file for complete search history.

(56) References Cited

U.S. PATENT DOCUMENTS 6,155,971 A * 12/2000 Calhoun ..... A61B 5/121 600/28
6,710,816 B1 * 3/2004 Minami ..... H04H 40/18 348/554
2003/0228020 A1 * 12/2003 Lentinturier ..... B06B 1/023 381/77
2003/0228021 A1 * 12/2003 Letinturier ..... B60R 25/104 381/86

(Continued)

FOREIGN PATENT DOCUMENTS

JP H05-048804 A 2/1993
JP 2012-218570 A 11/2012

(Continued)

OTHER PUBLICATIONS

Japan Patent Office. Office Action of foreign counterpart. dated Feb. 5, 2019.

*Primary Examiner* — David H Banh
(74) *Attorney, Agent, or Firm* — Hawaii Patent Services; Nathaniel K. Fedde; Kenton N. Fedde

(57) ABSTRACT

Provided is an electronic device that outputs a notification sound that takes into consideration those of older age. The electronic device is an electronic device that outputs a notification sound, and includes a frequency-setting unit and a notification-sound-control unit. The frequency-setting unit sets an initial frequency for the notification sound. The notification-sound-control unit causes the notification sound to be outputted at the initial frequency, and performs control so that the frequency of the notification sound is lowered from the initial frequency as time passes.

8 Claims, 6 Drawing Sheets

(56) References Cited

U.S. PATENT DOCUMENTS

| | | | | |
|---|---|---|---|---|
| 2013/0111312 | A1* | 5/2013 | Karmarkar | H04L 63/104<br>715/201 |
| 2014/0300476 | A1* | 10/2014 | Sabota | G08B 3/10<br>340/573.1 |
| 2015/0379835 | A1 | 12/2015 | Ogishi | |
| 2017/0018168 | A1* | 1/2017 | Beernink | G08B 7/06 |
| 2017/0225614 | A1* | 8/2017 | Park | B60R 21/00 |
| 2017/0258319 | A1* | 9/2017 | Weffers-albu | A61B 5/6898 |

FOREIGN PATENT DOCUMENTS

| | | | |
|---|---|---|---|
| JP | 2013-036660 | A | 2/2013 |
| JP | 2014-037933 | A | 2/2014 |

* cited by examiner

| AUDIBLE-RANGE AGE | OUTPUT FREQUENCY |
| --- | --- |
| UP TO 20 YEARS OLD | 19,000Hz |
| 21 TO 30 YEARS OLD | 16,000Hz |
| 31 TO 50 YEARS OLD | 12,000Hz |
| 51 YEARS OLD AND OLDER | 8,000Hz |

FIG.3

ELECTRONIC DEVICE AND IMAGE-FORMING APPARATUS

INCORPORATION BY REFERENCE

This application is based on and claims the benefit of priority from Japanese Patent Application No. 2016-148358 filed on Jul. 28, 2016, the contents of which are hereby incorporated by reference.

BACKGROUND

The present disclosure relates to an electronic device that outputs a notification sound, and an image-forming apparatus.

In an image-forming apparatus, when paper runs out or when a paper JAM or the like occurs, or when a facsimile signal is received, a notification sound is outputted to notify of the event. As technology for making it easy to hear this notification sound, technology has been proposed that sets frequencies at which the notification sounds can be easily distinguished, while taking into consideration the sounds that are generated from other apparatuses that are installed near the image-forming apparatus.

SUMMARY

The electronic device according to the present disclosure is an electronic device that outputs a notification sound, and includes a frequency-setting unit and a notification-sound-control unit. The frequency-setting unit sets an initial frequency for the notification sound. The notification-sound-control unit causes the notification sound to be outputted at the initial frequency, and performs control so that the frequency of the notification sound is lowered from the initial frequency as time passes.

The image-forming apparatus according to the present disclosure is such that the electronic device described above is mounted therein.

BRIEF DESCRIPTION OF THE DRAWINGS

FIG. 3 illustrates the relationship between the audible-range age and the notification sound frequency.

DETAILED DESCRIPTION

In the following, embodiments of the present disclosure will be explained in detail with reference to the drawings. In the embodiments described below, the same reference numbers will be used for configuration that illustrates the same function.

Figure 1:
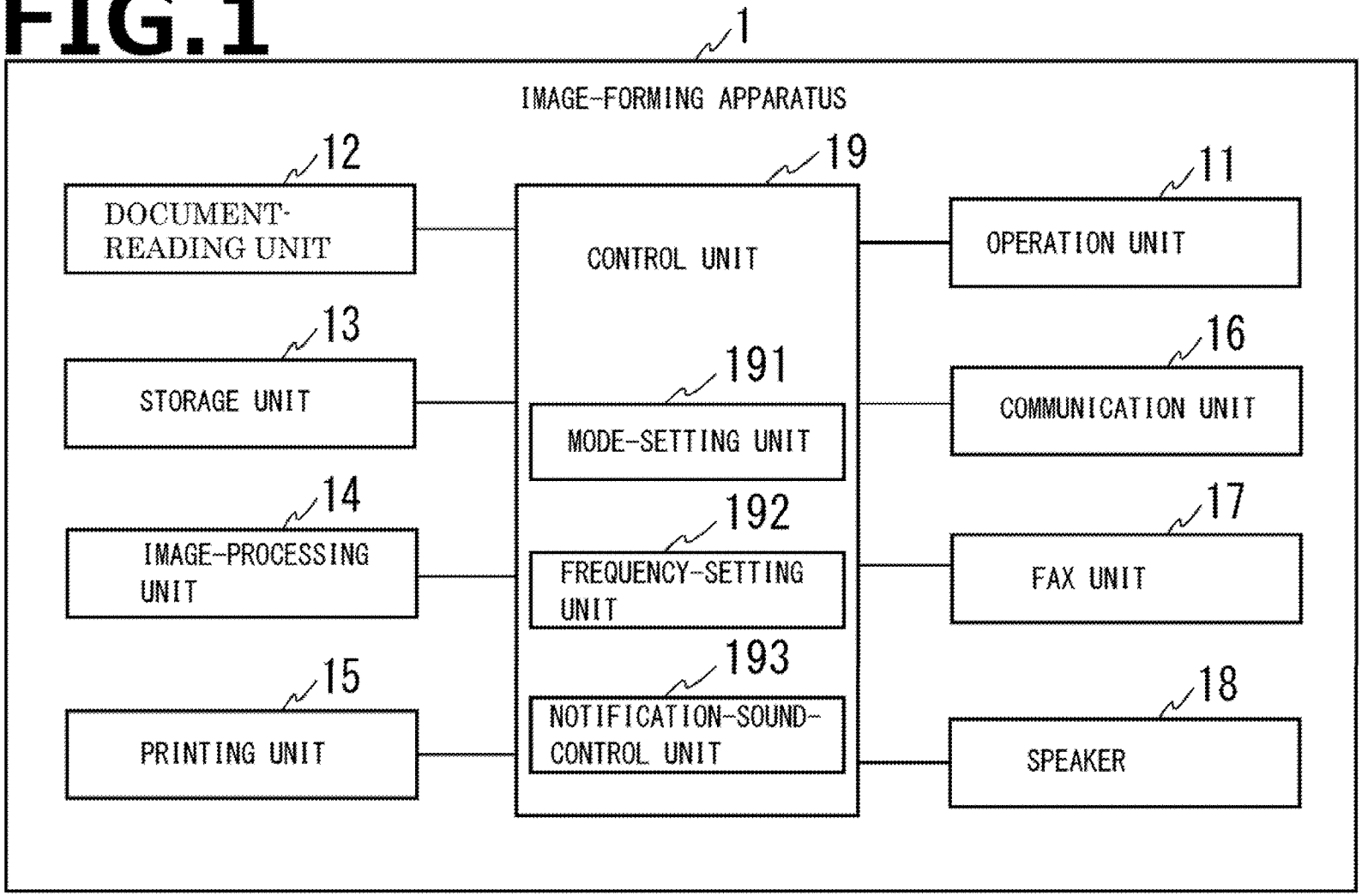
FIG. 1 is a functional block diagram illustrating the configuration of an image-forming apparatus of an embodiment of the present disclosure.

The image-forming apparatus 1 illustrated in FIG. 1 is a MFP, and includes an operation unit 11, a document-reading unit 12, a storage unit 13, an image-processing unit 14, a printing unit 15, a communication unit 16, a FAX unit 17, a speaker 18 and a control unit 19.

The operation unit 11 is such that operation buttons are provided on a liquid-crystal display unit. By the user inputting instructions by operating the operation unit 11, various settings of the image-forming apparatus are performed, and various functions such as image formation and the like are executed. The liquid-crystal display unit displays the status of the image-forming apparatus 1, displays the image-formation status, number of copies to be printed, and as a touch panel, makes it possible to perform functions such as double-sided printing, black-and-white reversal, and the like, or perform various settings such as a magnification setting, density setting and the like. As operation buttons there is a start button for giving an instruction to start a scanning operation, image formation and the like, a stop button for giving an instruction to stop the scanning operation, image formation and the like, a reset button that is used when setting the various settings of the image-forming apparatus 1 to the default state, and the like.

Figure 2:
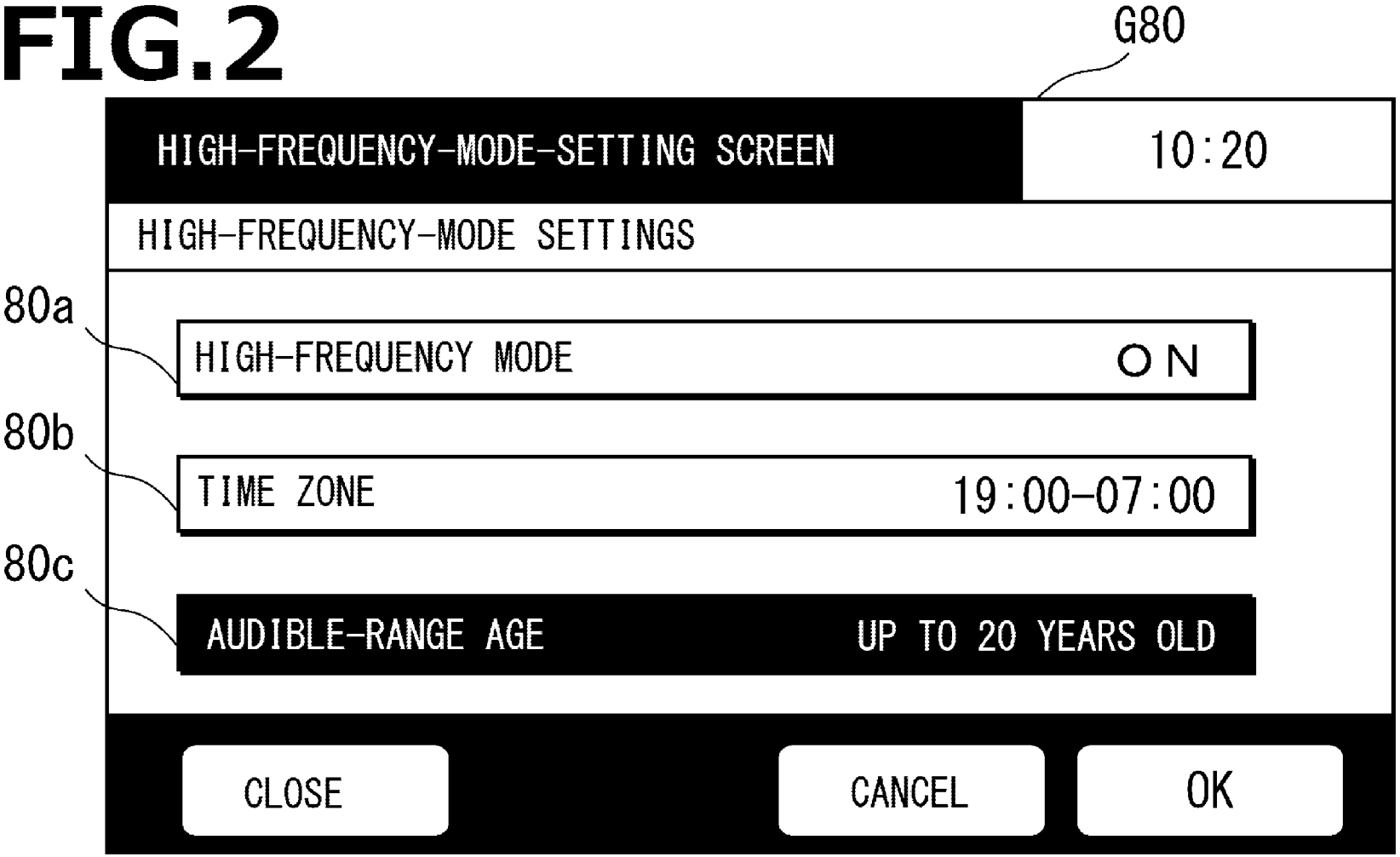
FIG. 2 illustrates an example of a frequency-mode-setting screen that is displayed on the operation unit illustrated in FIG. 1.

The user operates the operation unit 11 and causes the high-frequency-mode-setting screen G80 illustrated in FIG. 2 to be displayed, and is able to set the nighttime operation of the image-forming apparatus 1. The high-frequency-mode-setting screen G80 is provided with a setting field 80*a* for setting whether or not to set the image-forming apparatus 1 to the high-frequency mode, a setting field 80*b* for setting the time period during which the image-forming apparatus is set to the high-frequency mode, and a setting field 80*c* for setting the audible-range age for the high-frequency-mode-notification sound that is outputted in the high-frequency mode. The operation unit 11 receives the settings for the high-frequency mode via the high-frequency-mode-setting screen G80, and performs output setting for the high-frequency-mode-notification sound.

As illustrated in FIG. 3, in the high-frequency mode the output frequency of the notification sound that is outputted from the image-forming apparatus 1 according to the audible-range age is set, and the output frequency is set so as to be higher the lower the audible-range age is. It is said that typically it becomes more difficult to hear high frequencies the older the age. Therefore, by setting the audible-range age (setting field 80*c*) to correspond to the user's age, it is possible to easily set a notification sound that can be heard by the user and that takes into consideration older age. When the audible-range age is not set, a frequency that is equal to or greater than a so-called mosquito sound (17,000 Hz) that is a frequency that is hard for those of older age to hear may be set as the initial frequency for the high-frequency-mode-notification sound, for example.

Moreover, by setting the time period (setting field 80*b*) for setting the high-frequency mode to nighttime, it is possible to set the output of the nighttime notification sound so as to take into consideration those of older age. Furthermore, by setting the time period (setting field 80*b*) for setting the high-frequency mode to 24 hours, it is possible to set the high-frequency mode for all time periods.

The document-reading unit 12 is a scanner that reads a document image by irradiating light on a document that is fed by a document-feeding apparatus or on a document that is placed on a platen glass by the user, and receiving the reflected light and the like.

The storage unit 13 is storage means such as a semiconductor memory, HDD and the like, and is a storage means that stores image data that is read by the document-reading unit 12, and image data that is received by the communication unit 16.

The image-processing unit 14 is means for performing specified image processing on image data. In the image-processing unit 14, for example, image improvement processing such as enlargement or reduction processing, density adjustment, gradation adjustment and the like are performed.

The printing unit 15 is printing means for printing based on image data that is stored in the storage unit 13. The printing unit 15, for example, forms a latent image on the surface of a photosensitive drum based on image data that is read from the storage unit 13, performs image formation in which toner is used to form a toner image from the latent image, transfers the toner image from the photosensitive drum to printing paper, fixes the latent image on printing paper by a fixing apparatus, and outputs the printing paper.

The communication unit 16 has a function for transmitting and receiving various kinds of data to and from external terminals via a network such as LAN and the like.

The FAX unit 17 has a modem, and includes a facsimile-transmitting function that generates a facsimile signal from image data that is read by the document-reading unit 12, or from image data that is stored in the storage unit 13 and transmitting that facsimile signal via a public network, and a facsimile-receiving function that receives facsimile signals via a public network.

The speaker 18 has an amp, and has a function for outputting various notification sounds according to control by the notification-sound-control unit 193 (described later). A notification sound is an output sound of the image-forming apparatus 1, and for example, there is a sound for when there is no paper, when there is a paper JAM, a C call, a FAX receiving sound, an operation sound, printing complete sound, and the like.

The control unit 19 is connected to the operation unit 11, the document-reading unit 12, the storage unit 13, the image-processing unit 14, the printing unit 15, the communication unit 16, the FAX unit 17 and the speaker 18, and executes overall operation control of the image-forming apparatus 1 according to specified instruction information that is inputted from the operation unit 11. The printing unit 19 is an information-processing unit such as a microcomputer that includes ROM, RAM and the like. The ROM stores a control program for performing operation control of the image-forming apparatus 1. The control unit 19, by reading the control program that is stored in ROM and expanding the control program in RAM, performs overall control of the apparatus according to specified instruction information that is inputted from the operation unit 11. Moreover, the control unit 19 functions as a mode-setting unit 191, a frequency-setting unit 192, and a notification-sound-control unit 193.

The mode-setting unit 191 includes a normal mode that outputs a normal-mode-notification sound, and a high-frequency mode that outputs a high-frequency-mode-notification sound. When a setting (setting field 80*a*) for setting the high-frequency mode to ON is received by the operation unit 11 via the high-frequency-mode-setting screen G80 illustrated in FIG. 2, the mode-setting unit 191 sets the image-forming apparatus 1 to the high-frequency mode when the current time is the time period (setting field 80*b*) for the high-frequency mode. When the current time is not the time period for the high-frequency mode, the mode-setting unit 191 sets the image-forming apparatus 1 to the normal mode.

An illumination sensor that detects the surrounding brightness is provided in the image-forming apparatus 1, and when the illumination sensor detects that the surroundings have become dark, the mode-setting unit 191 may set the image-forming apparatus 1 to a high-frequency mode. In doing so, it is possible to change the notification sound of the image-forming apparatus 1 to correspond to the bedtime environment such as the light having been turned off and the like in consideration those of older age regardless of the time period (setting field 80*b*) that is set on the high-frequency-mode-setting screen G80.

The frequency-setting unit 192 sets the frequency of the notification sound. The frequency for the normal mode is initially set, for example, to 7,000 Hz or the like. When the image-forming apparatus 1 is set to the high-frequency mode by the mode-setting unit 191, the frequency-setting unit 192 sets the initial frequency of the high-frequency-mode-notification sound to a higher frequency than the frequency of the normal-mode-notification sound. The initial frequency is set to a frequency (refer to FIG. 3) that corresponds to the audible-range age on the high-frequency-mode-setting screen G80 illustrated in FIG. 2.

The notification-sound-control unit 193 performs output control of the notification sound that is outputted from the speaker 18. More specifically, in the normal mode, the notification-sound-control unit 193 performs control so that the normal-mode-notification sound is outputted. In the high-frequency mode, the notification-sound-control unit 193 performs control so that a notification sound is outputted as the high-frequency-mode-notification sound at an initial frequency that is set by the frequency-setting unit 192, and so that as time passes, the frequency of the notification sound decreases from the initial frequency. Moreover, together with this, the notification-sound-control unit 193 performs control so that the volume of the notification sound decreases to correspond with the decrease in the frequency of the notification sound.

Figure 4:
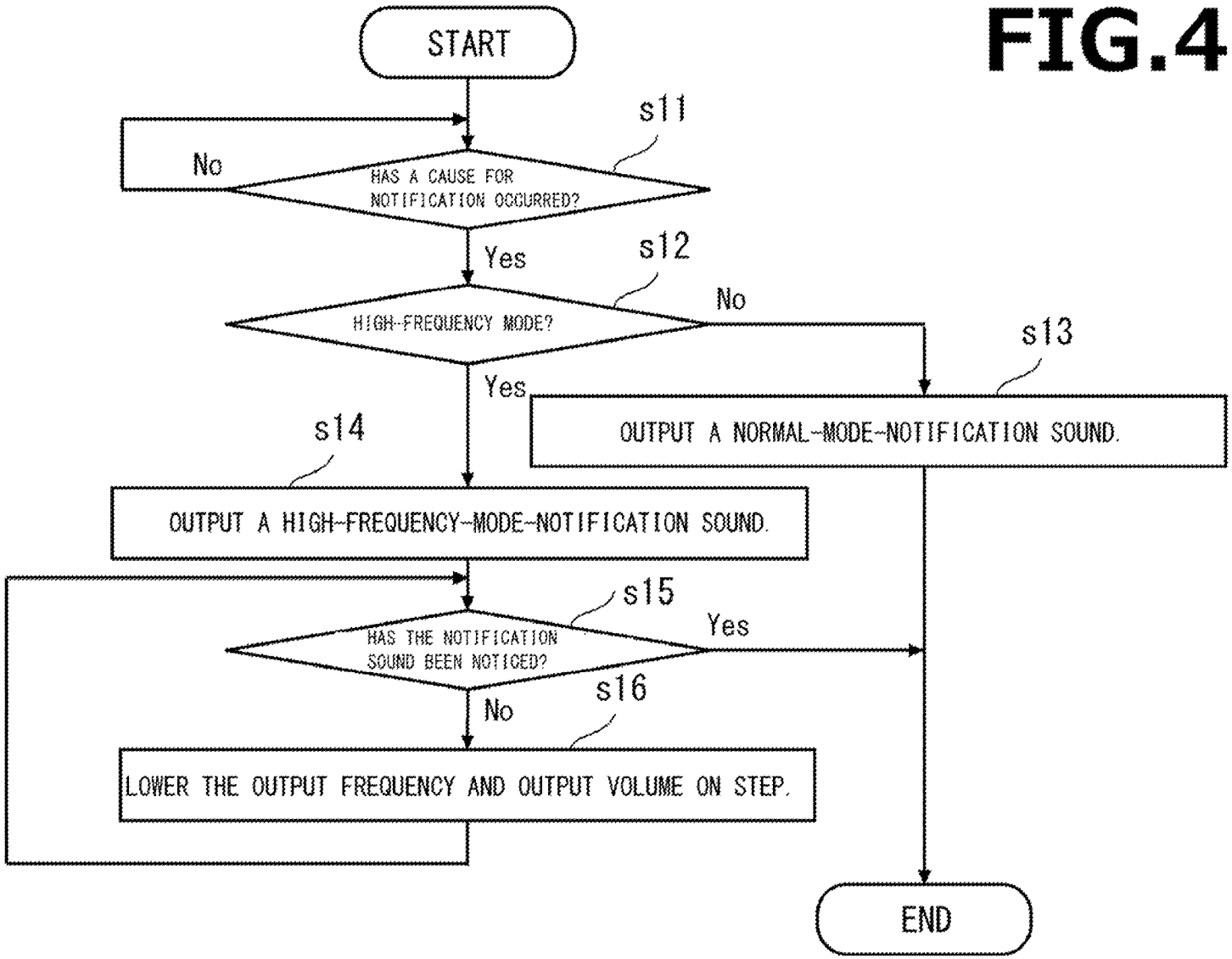
FIG. 4 is a flowchart illustrating the flow of the processing by the notification-sound-control unit illustrated in FIG. 1.

More specifically, referring to FIG. 4, the flow of the operation by the image-processing apparatus 1 for outputting the notification sound will be explained.

The notification-control unit 193 waits until a cause for notification occurs such as when an abnormality occurs, when a FAX is received or the like (step S11, Step S11: NO).

When a cause for notification occurs (step S11: YES), the notification-sound-control unit 193 determines whether or not the mode is the high-frequency mode (step S12). On the high-frequency-mode-setting screen G80 illustrated in FIG. 2, when the high-frequency mode (setting field 80*a*) is set to ON, and the current time is the time period for the high-frequency mode (setting field 80*b*), the image-forming apparatus 1 is set to the high-frequency mode by the mode-setting unit 191. When the mode is not the high-frequency mode (step S12: NO), the notification-sound-control unit 193 causes the normal-mode-notification sound to be outputted from the speaker 18 (step S13), and ends this process.

However, when the mode is the high-frequency mode (step S12: YES), the notification-sound-control unit 193 causes the high-frequency-mode-notification sound to be outputted from the speaker 18 at the initial frequency (step S14). Then, the notification-sound-control unit 193 determines whether or not the user has noticed the notification sound (step S15). This is because the high-frequency-notification sound is outputted at high frequency, and a person able to hear the notification sound may not be near the image-forming apparatus 1. When the operation unit 11 is operated while the notification sound is being outputted, the notification-sound-control unit 193, for example, may determine that the user noticed the notification sound, and when the operation unit is not operated while the notification sound is being outputted, the notification-sound-control unit 193 may determine that the user has not noticed the notification sound.

When the user does not notice the notification sound (step S15: NO), the notification-sound-control unit 193 controls the speaker 18 so that the output frequency and output volume of the notification sound are lowered one step as time passes (step S16), and returns to the processing in step S15. As a result, the notification-sound-control unit 193 performs control so as to gradually lower the notification sound from the initial frequency as time passes until the user notices the notification sound, and also performs control so as to gradually lower the volume of the notification sound to correspond to the lowering of the frequency of the notification sound.

Figure 5A:
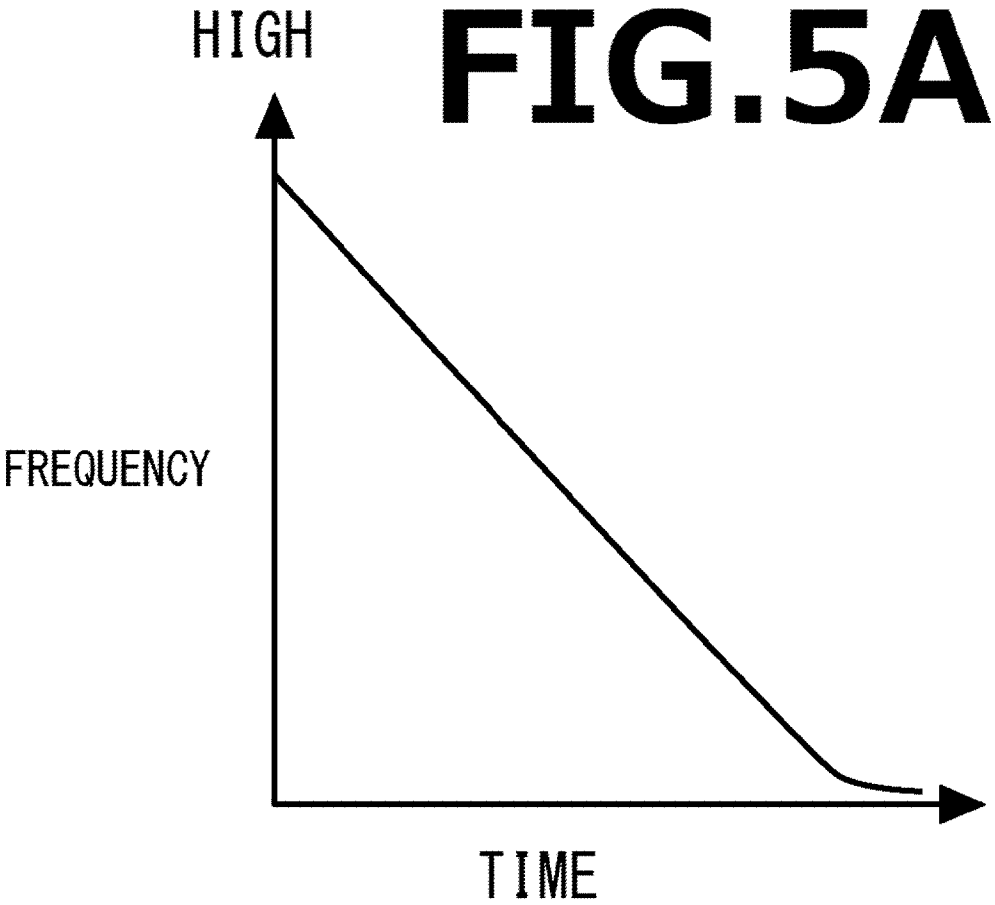
FIG. 5A illustrates the output frequency of the notification sound over time.
Figure 5B:
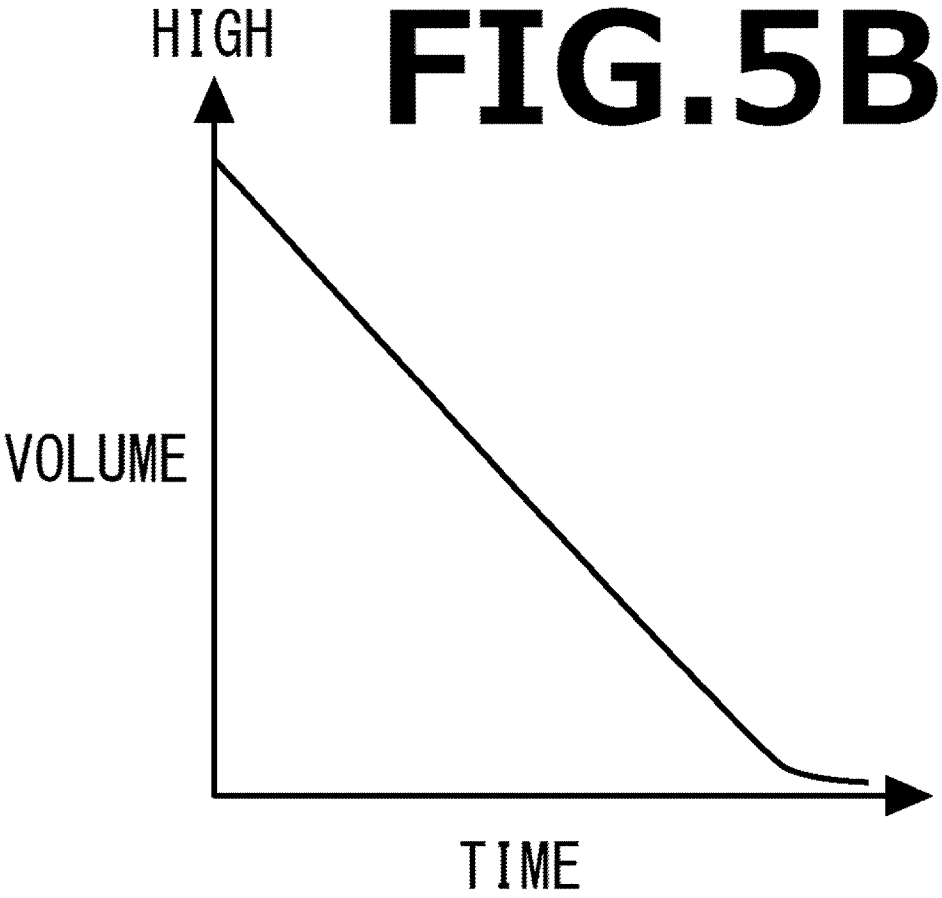
FIG. 5B illustrates the output volume of the notification sound over time.

In other words, as illustrated in FIG. 5, the high-frequency-mode-notification sound is first outputted at the highest frequency and highest volume, and control is performed so that as time passes, the frequency and volume become lower until the user notices the notification sound. When the frequency is high, it is difficult for those of older age to notice the notification sound even when the volume is high, so by raising the first outputted volume, it is possible to control the sound so that a user having a comparatively low age will quickly be able to notice the notification sound and take action. When the user does not notice the notification sound, or does not quickly take action, the output frequency and output volume of the notification sound is gradually lowered, so as time passes, it becomes easier to hear the notification sound and the number of users able to take action increases. Finally, even when the output frequency of the notification sound becomes a low frequency that even an older person can hear, the output volume is low, so will not inconvenience an older person. The frequency of the notification sound illustrated in FIG. 5A and the volume of the notification sound illustrated in FIG. 5B are illustrated as becoming lower (gradually) in proportion to the passage of time, however, the frequency and volume may also be lowered in steps (step shape), and it is also possible for one to be lowered gradually while the other is lowered in steps.

When a user notices the notification sound (step S15: YES), this process ends. When a user does not notice the notification sound, output of the notification sound is stopped.

In this way, the image-forming apparatus 1 of this embodiment includes a frequency-setting unit 192 that sets the initial frequency of the notification sound, and a notification-sound-control unit 193 that performs control so that frequency of the notification sound decreases from the initial frequency as time passes. As a result, the image-forming apparatus 1 is able to output a notification sound that can be heard by a user, and also takes into consideration those of older age. Moreover, it is also possible for the initial frequency of the high-frequency mode to be such that an animal like a guidance dog or the like can hear the sound and can notify a user that the image-forming apparatus 1 is outputting a notification sound.

In typical technology, when a notification sound is outputted from an image-forming apparatus, often those responding to the sound are comparatively young, and outputting a notification sound that takes into consideration those of older age was not possible. However, according to the present disclosure, it is possible to output a notification sound that takes into consideration those of older age.

In this embodiment, an example of an image-forming apparatus 1 was explained, however this technology is not limited to an image-forming apparatus 1, and may also be applied to an electronic device that outputs a notification sound, for example, a smartphone, a portable telephone, a PHS, a tablet terminal, and the like.

The technology according to the present disclosure is not limited to the embodiments described above, and needless to say various modifications are possible within a range that does not depart from the scope of the present disclosure.

What is claimed is:

1. An electronic device that is an electronic device that outputs a notification sound, comprising:

a frequency-setting unit that sets an initial frequency for the notification sound;

an operation unit that receives a setting for an audible-range age, wherein the frequency-setting unit sets a preset frequency that corresponds to the audible-range age that is received by the operation unit as the initial frequency such that the initial frequency is set higher when the audible-range age is set lower; and a notification-sound-control unit that performs control so that the notification sound is outputted at the initial frequency, and so that, as time passes, the frequency of the notification sound is lowered from the initial frequency and the volume of the notification sound is lowered to correspond to the lowering of the frequency of the notification sound.

2. The electronic device according to claim 1, further comprising a mode-setting unit that comprises a normal mode that outputs a normal-mode notification sound and a high-frequency mode that outputs a high-frequency-mode-notification sound; wherein the frequency-setting unit sets the initial frequency in the high-frequency mode to be higher than the frequency of the normal-mode-notification sound.

3. The electronic device according to claim 2, wherein the mode-setting unit sets the high-frequency mode when the time becomes a set time.

4. The electronic device according to claim 2, wherein an illumination sensor is provided that detects the brightness of the surroundings; and the mode-setting unit sets the high-frequency mode based on the detected brightness.

5. An image-forming apparatus that comprises an electronic device according to claim 1, wherein the image-forming apparatus is configured for printing or facsimile.

6. The image forming apparatus according to claim 5, wherein the notification sound is triggered by an event selected from:

no paper, a paper jam, a facsimile receipt, and printing complete.

7. The electronic device according to claim 1, wherein the frequency-setting unit is configured to, when the audible-range age is not set, set the initial frequency to be greater or equal to or greater than a mosquito sound.

8. The electronic device according to claim 1, wherein the frequency-setting unit is configured to, when the audible-range age is not set, set the initial frequency to be greater or equal to or greater than 17,000 Hz.

* * * * *